US007431617B2

(12) United States Patent
Yamaji

(10) Patent No.: US 7,431,617 B2
(45) Date of Patent: Oct. 7, 2008

(54) CONNECTOR

(75) Inventor: Takahiro Yamaji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/651,877

(22) Filed: Jan. 10, 2007

(65) Prior Publication Data

US 2007/0167078 A1 Jul. 19, 2007

(30) Foreign Application Priority Data

Jan. 17, 2006 (JP) ..... 2006-008202

(51) Int. Cl.
*H01R 13/648* (2006.01)

(52) U.S. Cl. ..... 439/609; 439/74

(58) Field of Classification Search ..... 439/609, 439/74, 607, 608, 610
See application file for complete search history.

(56) References Cited

U.S. PATENT DOCUMENTS 4,718,867 A * 1/1988 Seidel et al. ..... 439/609
4,936,795 A * 6/1990 Kawai et al. ..... 439/609
5,637,014 A * 6/1997 Sukegawa et al. ..... 439/607
5,975,957 A 11/1999 Noda et al.
6,485,328 B1 * 11/2002 Wu ..... 439/567
6,923,659 B2 * 8/2005 Zhang et al. ..... 439/74

FOREIGN PATENT DOCUMENTS

| | | |
|---|---|---|
| JP | 03-013681 | 2/1991 |
| JP | 09-148008 | 6/1997 |
| JP | 10 289760 | 10/1998 |
| JP | 2000-39621 A | 8/2001 |
| JP | 2004-327244 A | 4/2004 |
| JP | 2005-026235 | 1/2005 |

OTHER PUBLICATIONS

Japanese Office Action and English translation of same.

* cited by examiner

*Primary Examiner*—Gary F. Paumen
(74) *Attorney, Agent, or Firm*—Collard & Roe, P.C.

(57) ABSTRACT

A connector configured to mate with a corresponding connector. The connector comprises a conductive shell, a housing and a plurality of terminals. The conductive shell comprises an elastic portion and a plate portion having an opening. The plate portion is configured to define a first region and a second region and arranged between the first region and the second region. The elastic portion comprises a first bend section arranged on the plate portion, a second bend section arranged in the first region, a contact section arranged in the second region, a first piece extending between the first bend section and the second bend section and a second piece extending between the second bend section and the contact section through the opening. The housing is arranged in the first region. The plurality of terminals is retained by the housing.

9 Claims, 11 Drawing Sheets

CONNECTOR

BACKGROUND OF THE INVENTION

This invention relates to a connector, and more particularly to a connector comprising a conductive shell configured to mate with a complementary conductive shell of a complementary connector.

For example, a known connector of this type is disclosed in JP-A H10-289760, which is incorporated herein by reference in its entirety. The disclosed connector includes a conductive shell having an opening and a spring piece extending from an inside edge of the opening. Because the spring piece is smaller than the opening and has an approximately flat shape, the spring piece can not provide large elastic force so that an electrical connection between the conductive shell and a complementary conductive shell is unreliable.

SUMMARY OF THE INVENTION

Therefore, it is an object of the present invention to provide a connector comprising a conductive shell provided with an elastic portion which connects the conductive shell to a complementary conductive shell more surely than the disclosed technique.

According to an aspect of the present invention, there is provided a connector configured to mate with a corresponding connector. The connector comprises a conductive shell, a housing and a plurality of terminals. The conductive shell comprises an elastic portion and a plate portion having an opening. The plate portion is configured to define a first region and a second region and arranged between the first region and the second region. The elastic portion comprises a first bend section arranged on the plate portion, a second bend section arranged in the first region, a contact section arranged in the second region, a first piece extending between the first bend section and the second bend section and a second piece extending between the second bend section and the contact section through the opening. The housing is arranged in the first region. The plurality of terminals is retained by the housing.

These and other objects, features and advantages of the present invention will become more apparent upon reading of the following detailed description along with the accompanied drawings.

DESCRIPTION OF PREFERRED EMBODIMENTS

Figure 1:
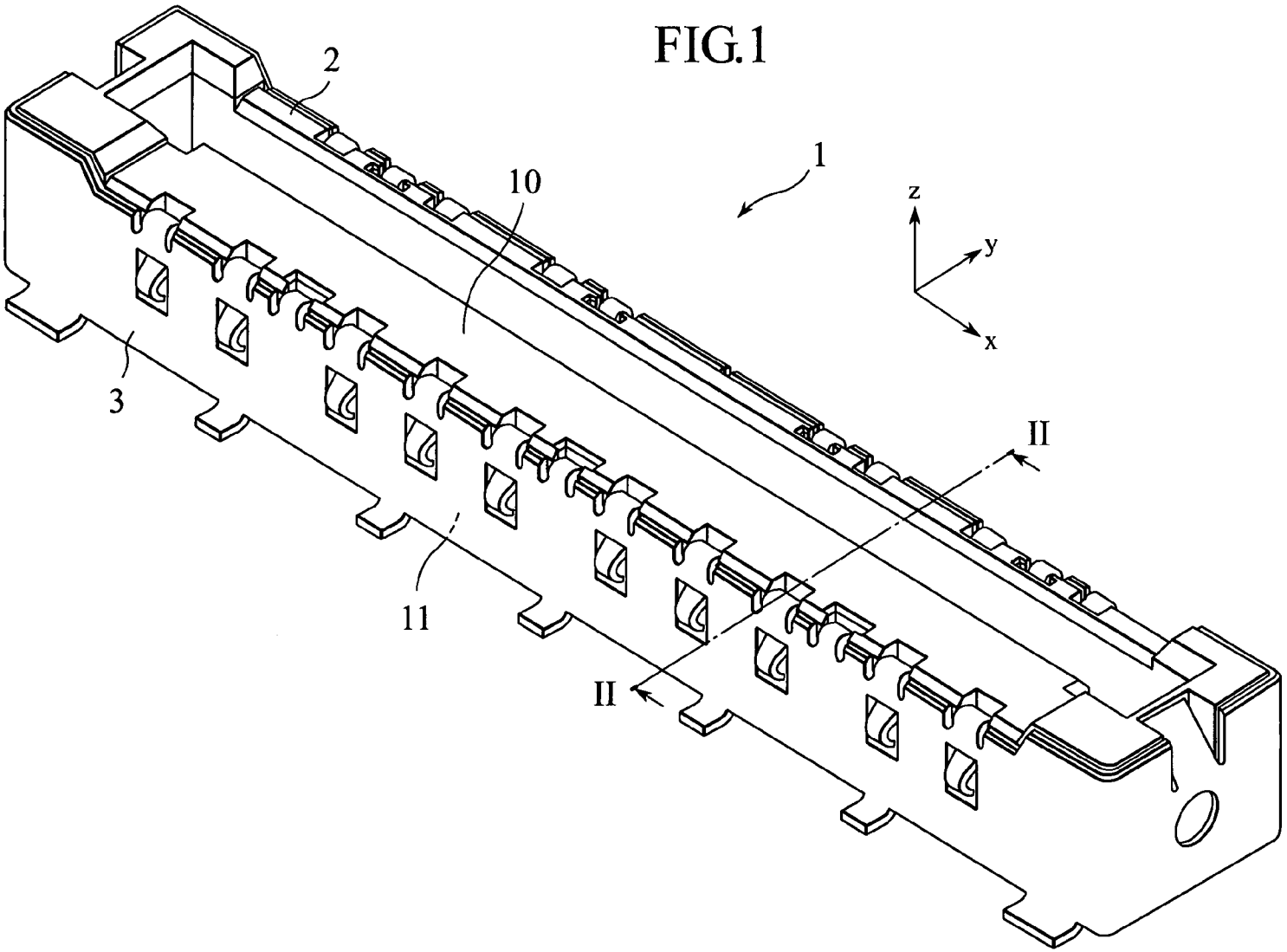
FIG. 1 is a perspective view of a connector according to a first embodiment of the present invention.
Figure 2:
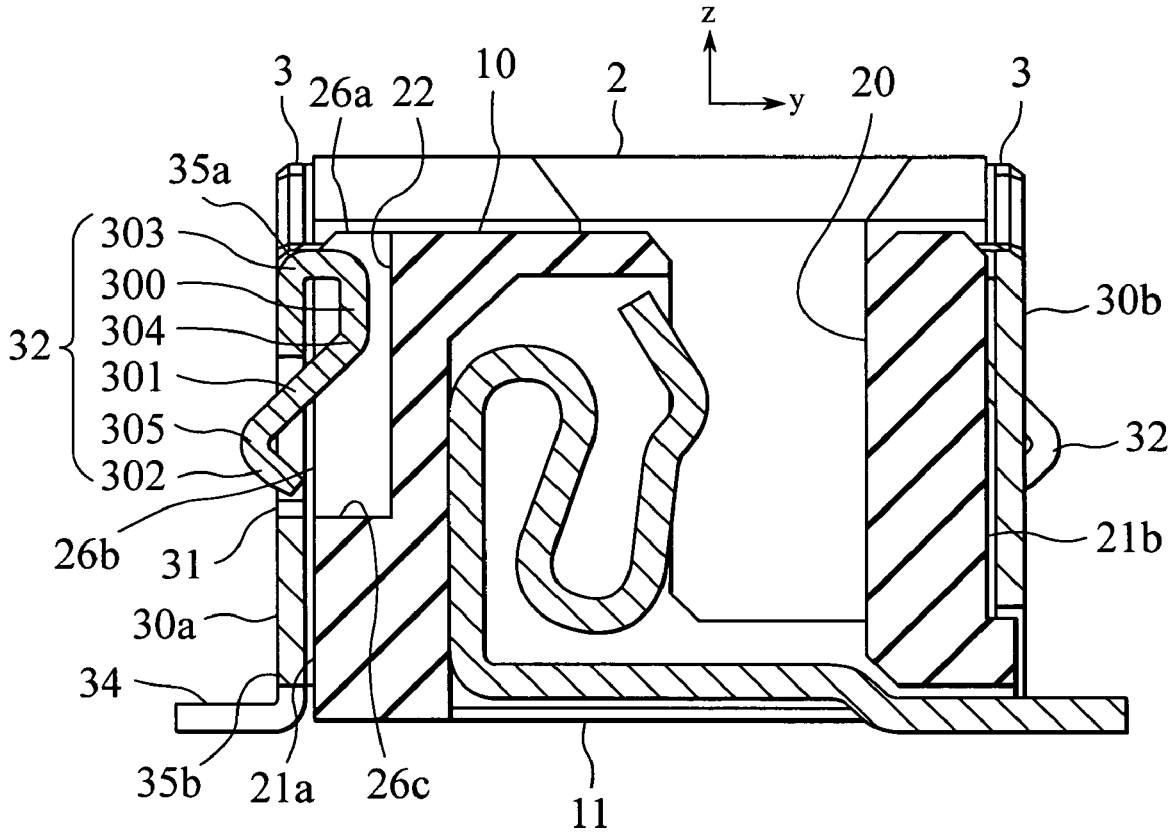
FIG. 2 is a cross sectional view of the connector, taken along line II-II of FIG. 1.
Figure 3:
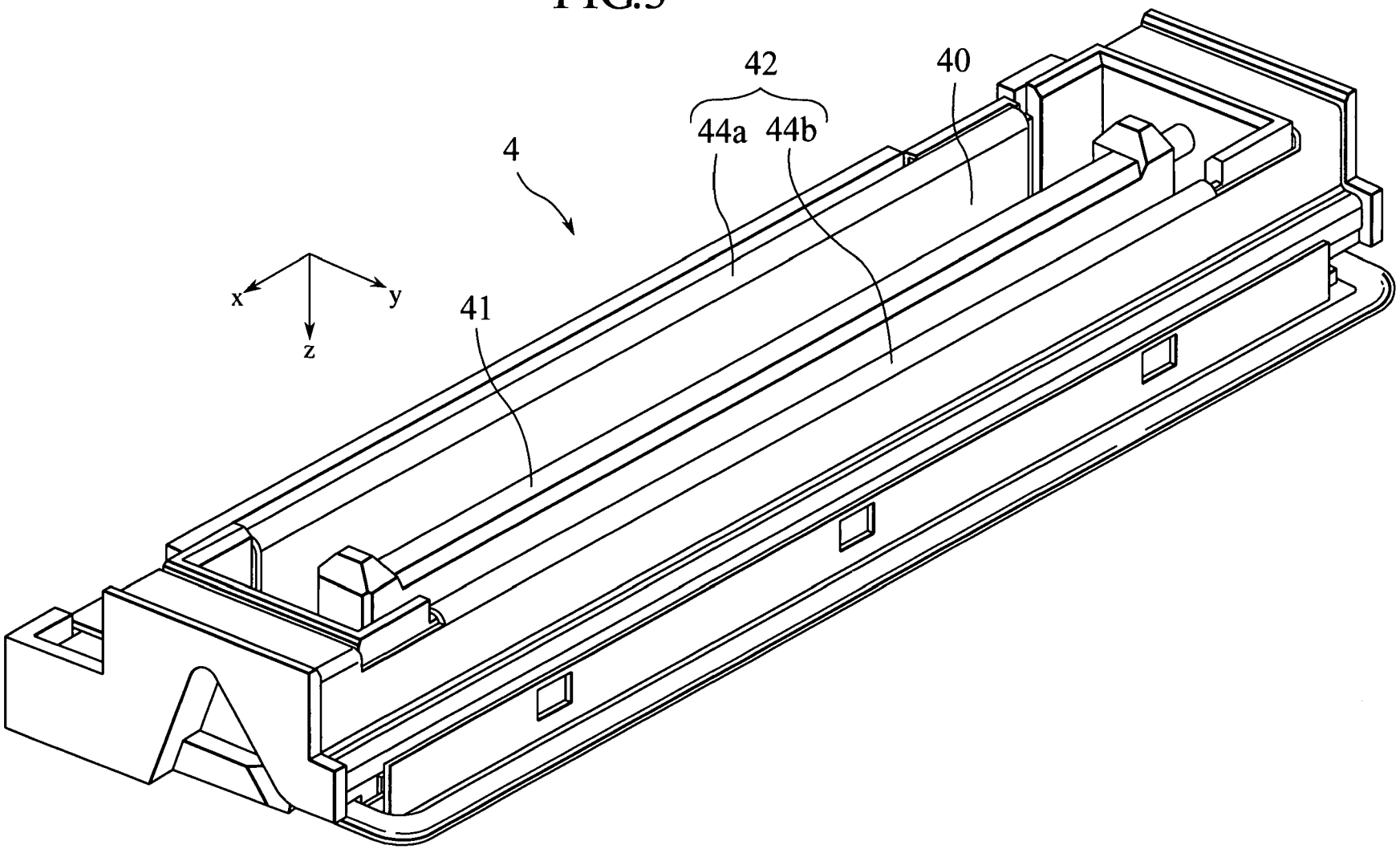
FIG. 3 is a perspective view of the complementary connector configured to be mated with the connector of FIG. 1.
Figure 4:
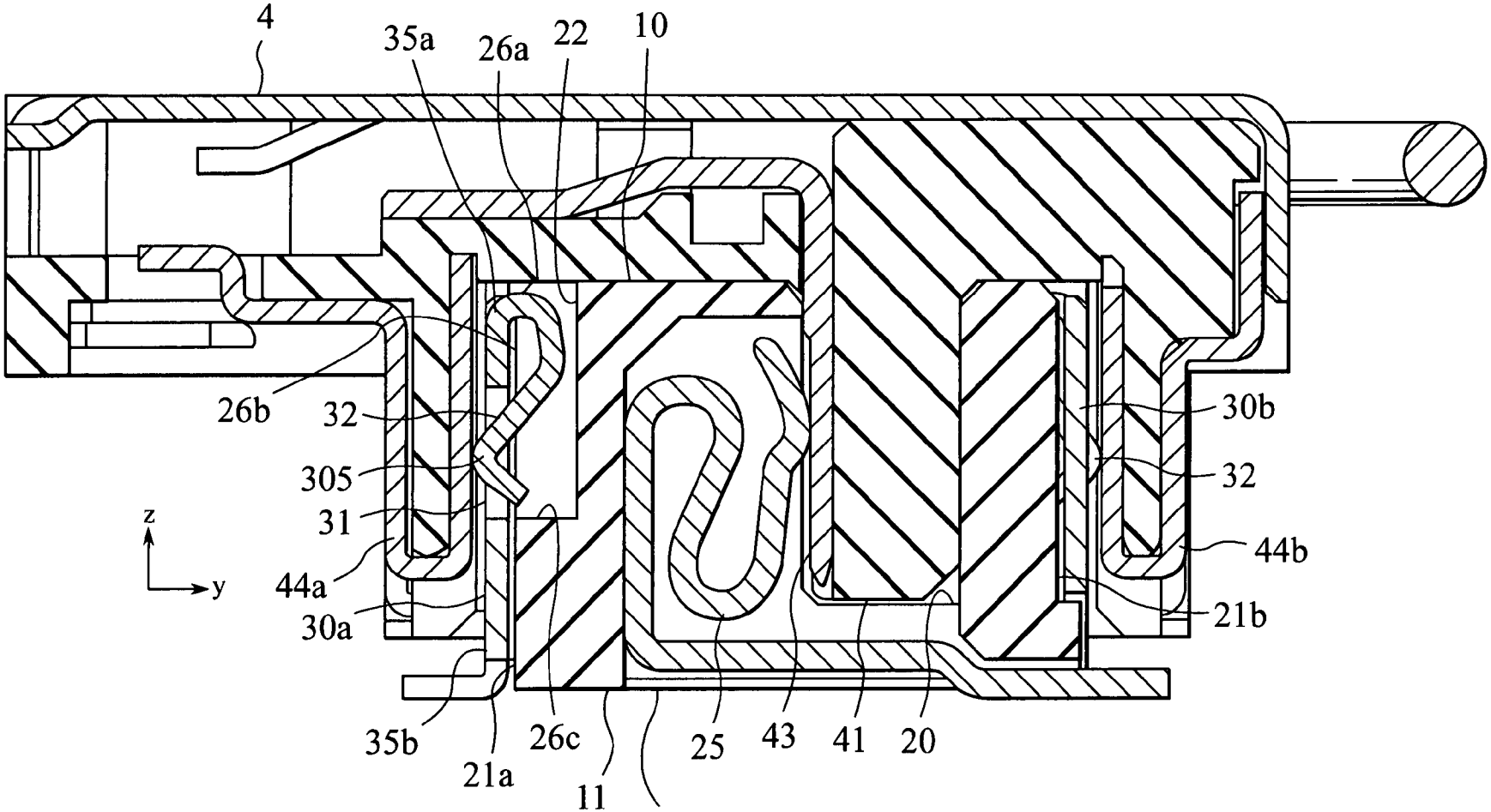
FIG. 4 is a cross sectional view of the connector and the complementary connector mated with the connector, taken along the line II-II of FIG. 1.

FIG. 1 and FIG. 2 shows a connector 1 of a first embodiment of the present invention, which is for example mountable on a circuit board (not shown). The connector 1 of FIG. 1 has a front end 10 and a rear end 11. The front end 10 and the rear end 11 are arranged at opposite ends of the connector 1 in a z-direction. The rear end 11 is connected with the circuit board. The connector 1 is configured to be mated with the complementary connector 4 of FIG. 3 in the z-direction. Referring to FIG. 4, in a state where the connector 1 is mated with the complementary connector 4, the front end 10 is positioned deeper in the complementary connector 4 than the rear end 11.

The connector 1 and the complementary connector 4 of this embodiment are mounted on circuit boards, respectively. Either one or both of the connector 1 and the complementary connector 4 may be parts of cable assemblies.

Referring back to FIG. 1 and FIG. 2, the connector 1 comprises a housing 2, a conductive shell 3 and a plurality of terminals 25.

Figure 5:
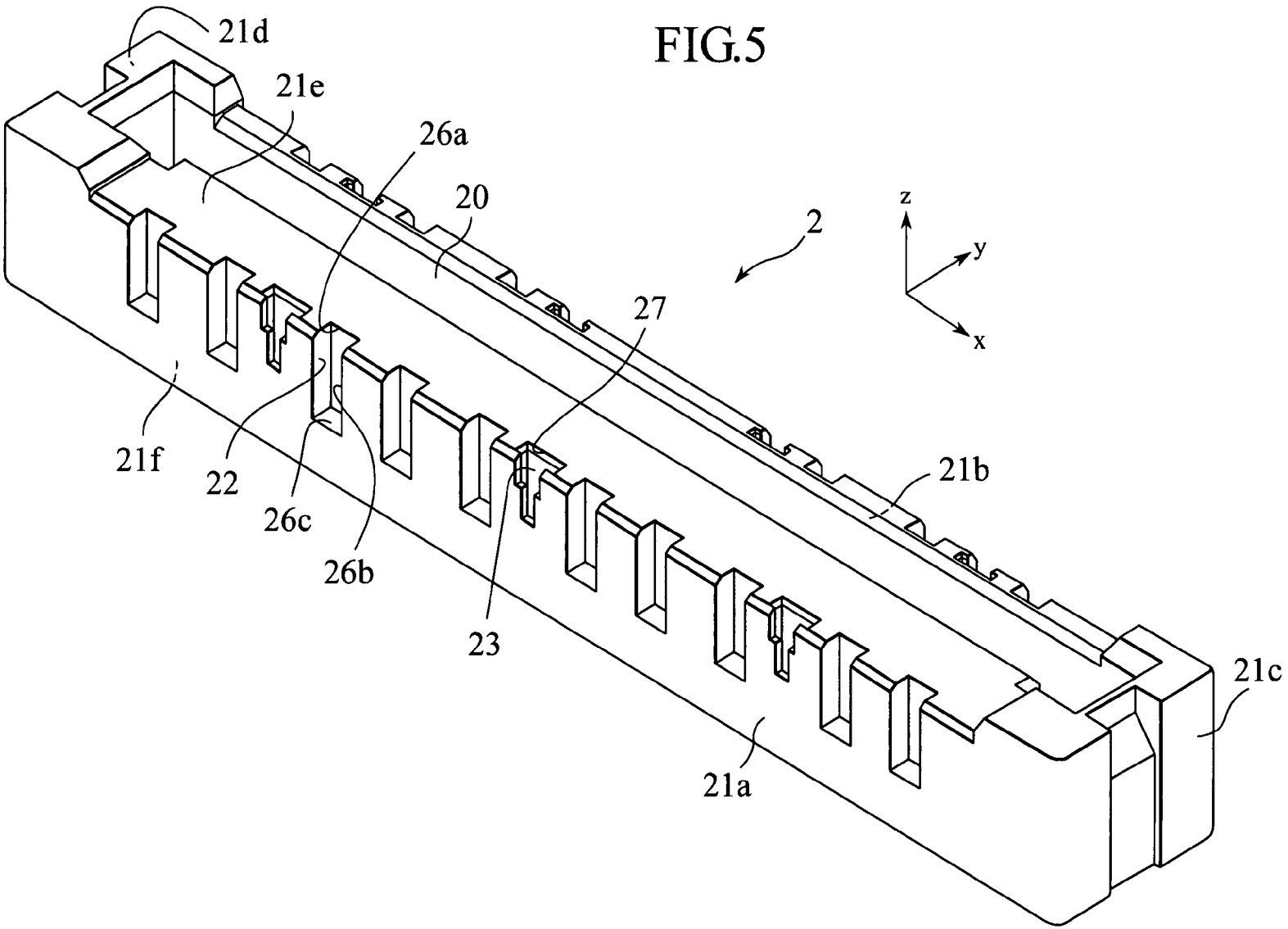
FIG. 5 is a perspective view of the housing of FIG. 1.

Referring to FIG. 5, the housing 2 has a profile of an approximately rectangular parallelepiped shape extending along an x-direction. The housing 2 has a first surface 21*a* and a second surface 21*b* arranged at opposite sides of the housing 2 in a y-direction. The housing 2 has a third surface 21*c* and a fourth surface 21*d* arranged at opposite sides of the housing 2 in the x-direction. The housing 2 has a front surface 21*e* arranged at the front end 10 and a rear surface 21*f* arranged at the rear end 11.

The housing 2 is further provided with a slot 20, a plurality of first recessed portions 22, a plurality of second recessed portions 23.

The slot 20 has an insertion opening arranged in the front surface 21*e*. The slot 20 is elongated from the insertion opening into the housing 2 along the z-direction. Referring to FIG. 2, the terminals 25 are arranged along the x-direction in the slot 20.

The first recessed portion 22 has a first opening 26*a* as seen along the z-direction, a second opening 26*b* as seen along the y-direction and a bottom inner surface 26*c*. The first opening 26*a* is arranged in the front surface 21*e* and adjacent to either one of the first surface 21*a* and the second surface 21*b*. The second opening 26*b* is arranged in either one of the first surface 21*a* and the second surface 21*b* and adjacent to the first openings 26*a*, respectively. The bottom inner surfaces 26*c* is positioned between the front surface 21*e* and the rear surface 21*f* and elongated from the either one of the first surface 21*a* and the second surface 21*b* into the housing. The first recessed portion 22 is elongated from the first opening 26*a* to the bottom inner surface 26*c*.

The second recessed portion 23 has a third opening 27 as seen along the z-direction. The third opening 27 is arranged in the front surface 21*e* and adjacent to either one of the first surface 21*a* and the second surface 21*b*. The second recessed portion 23 is elongated from the third opening 27 into the housing 2 along the z-direction.

Figure 6:
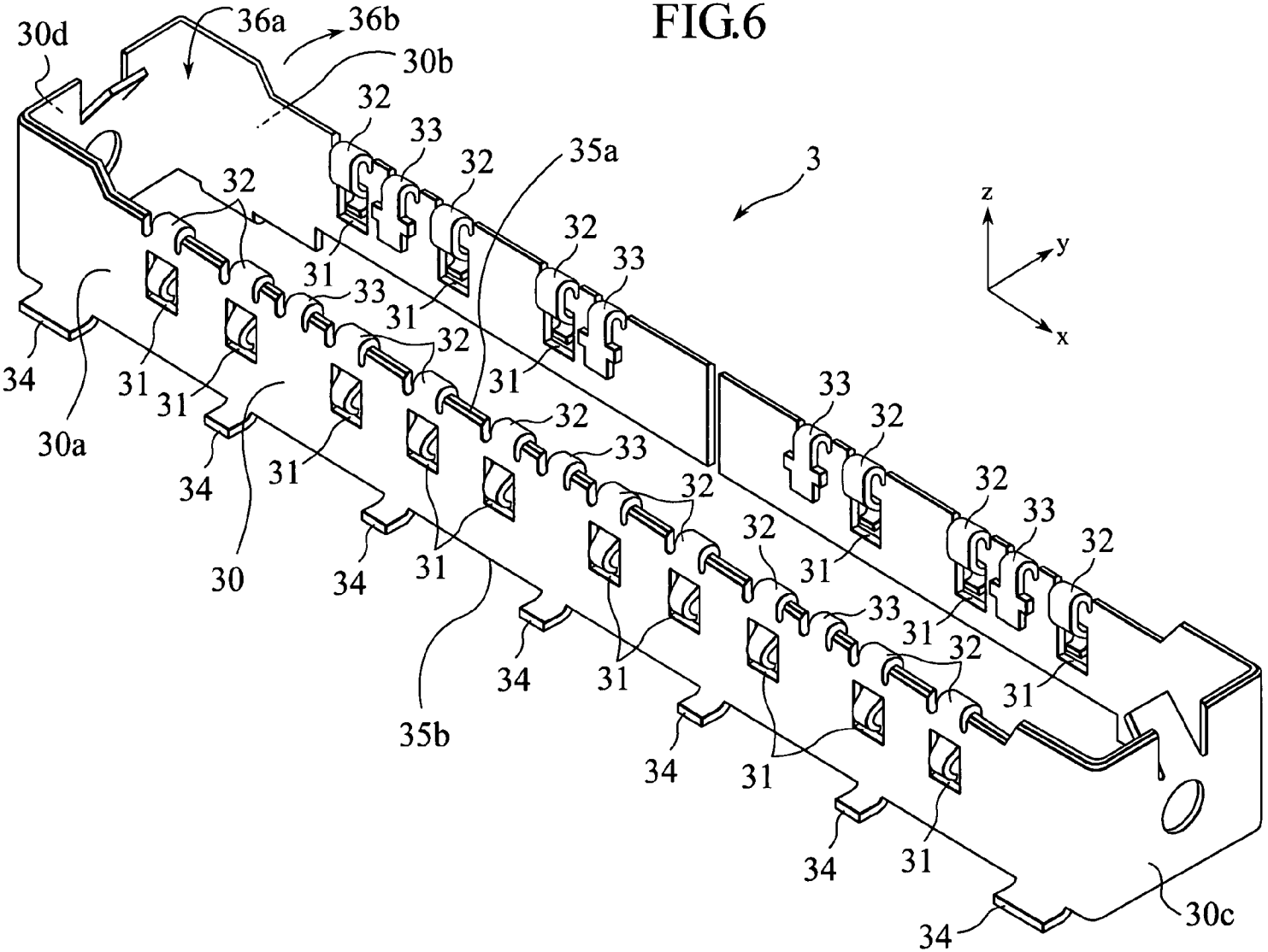
FIG. 6 is a perspective view of the conductive shell of FIG. 1.

Referring to FIG. 6, the conductive shell 3 comprises a plate portion 30, a plurality of elastic portions 32, a plurality of hooks 33, a plurality of legs 34. The conductive shell 3 is made from a single metal plate.

The plate portion 30 has a front edge 35*a* arranged at the front portion 10 and a rear edge 35*b* arranged at the rear portion 11. The plate portion 30 extends between the front edge 35*a* and the rear edge 35*b*. The plate portion 30 has a first wall 30*a*, a second wall 30*b*, a third wall 30*c* and a fourth wall 30*d* configured to cover the first surface 21*a*, the second surface 21*b*, the third surface 21*c* and the fourth surface 21*d*, respectively.

The plate portion 30 defines a first region 36*a* and a second region 36*b*. The first region 36*a* is an inside region of the plate portion 30. The second region 36*b* is an outside region of the plate portion 30.

The first wall 30*a* and the second wall 30*b* comprise a plurality of holes 31 arranged along the x-direction. The holes 31 of the first wall 30*a* and the second wall 30*b* are arranged to pierce the first wall 30*a* and the second wall 30*b* in the y-direction, respectively. The first wall 30*a* and the second wall 30*b* may comprise a plurality of openings having another shape instead of the holes 31 of this embodiment.

Referring to FIG. 2, the elastic portion 32 has a first piece 300, a second piece 301, a third piece 302, a first bend section 303, a second bend section 304 and a contact section 305.

As shown in FIG. 2, the first bend section 303 is arranged on the front edge 35*a* and has a U-shape which is rearwardly opened. The first bend section 303 and the hole 31 are arranged along the z-direction. The second bend section 304 is arranged in the first region 36*a*. The first piece 300 extends rearwardly from the first bend section 303 to the second bend section 304. The contact section 305 is arranged in the second region 36*b*. The second piece 301 extends rearwardly and outwardly from the second bend section 304 to the contact section 305 through the hole 31. The third piece 302 extends rearwardly and inwardly from the contact section 305.

Figure 7:
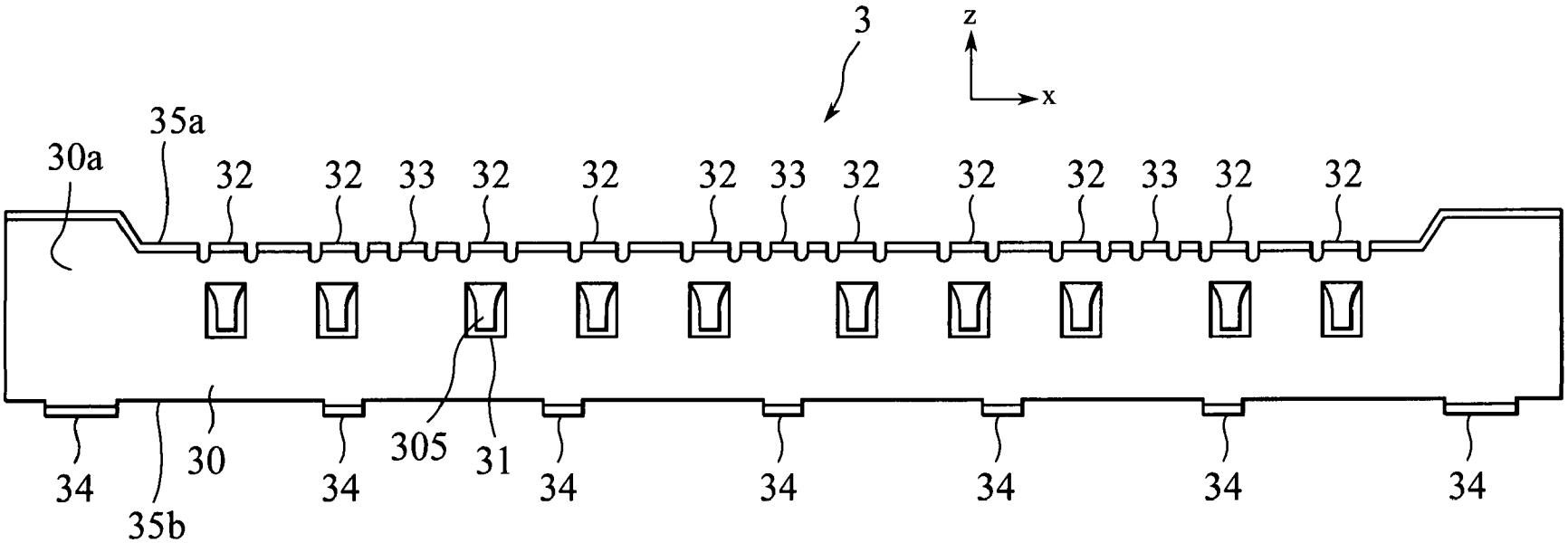
FIG. 7 is a front view of the conductive shell of FIG. 6.

Referring to FIG. 7, the contact section 305 has a first width along the x-direction. The hole 31 has a second width along the x-direction. The first width is smaller than the second width. The elastic portion 32 may have a portion wider than the hole 31.

The elastic portion 32 has a first length from the first bend section 303 to the contact section 305. The hole 31 has a second length along the z-direction. The first length is larger than the second length.

Referring to FIG. 2, the first recessed portions 22 and the elastic portions 32 are arranged to be over rapped in the y-direction.

Referring to FIG. 6, the hooks 33 extend rearwardly from the front edge 35*a* of the first wall 30*a* and the second wall 30*b*. The hooks 33 are elongated in the first region 36*a* and have tab-like ends configured to be press-fit into the second recessed portions 23, as shown in FIG. 3.

The legs 34 extends outwardly from the rear edge 35*b* of the first wall 30*a* and the second wall 30*b* along the y-direction. The legs 34 are configured to be connected to ground terminals on the circuit board.

Referring to FIG. 5 and FIG. 6, in a fabrication of the connector 1, the housing 2 mounted on the circuit board is inserted into the first region 36*a* surrounded by the conductive shell 3 from the rear edge 35*b* to the front edge 35*a*. During the insertion, the elastic portions 32 are inserted into the first recessed portions 22 from the first opening 26*a*, while the hooks 33 are pressed into the second recessed portions 23 from the third openings 27.

Referring to FIG. 2, the elastic portion 32 is elastically supported by the plate portion 30. There is a gap between the elastic portion 32 and the first recessed portion 22. If the contact section 305 is pushed inwardly, the elastic portion 32 is movable deeper in the first recessed portion 22.

Referring to FIG. 3 and FIG. 4, the complementary connector 4 comprises an outer slot 40, a protrusion 41, a complementary conductive shell 42 and a plurality of complementary terminals 43.

The outer slot 40 is elongated along the x-direction and is configured to receive the connector 1 inserted along the z-direction.

The protrusion 41 is arranged in the outer slot 40 and has a plate-like shape extending along the z-direction and the x-direction. The protrusion 41 is configured to be inserted into the slot 20 of FIG. 5.

Referring to FIG. 4, the complementary terminals 43 are, at least in part, positioned on a surface of the protrusion 41 and extends along the z-direction. The complementary terminals 43 are arranged along the x-direction and configured to contact with the terminals 25 when the connector 1 is mated with the complementary connector 4.

The complementary conductive shell 42 comprises a first outer plate 44*a* and a second outer plate 44*b*. The first outer plate 44*a* and the second outer plate 44*b* are arranged on opposite inner sides of the outer slot 40 in the y-direction. Each of the first outer plate 44*a* and the second outer plate 44*b* extends along the z-direction and the x-direction.

Referring to FIG. 4, when the connector 1 is mated with the complementary connector 4, the first outer plate 44*a* and the second outer plate 44*b* press the contact sections 305 inwardly so as to be electrically connected with the first wall 30*a* and the second wall 30*b* through the elastic portions 32, respectively. The mated connector 1 is located between the first outer plate 44*a* and the second outer plate 44*b*. The protrusion 41 is inserted in the slot 20 so that the complementary terminals 43 are electrically connected with the terminals 25.

Figure 8:
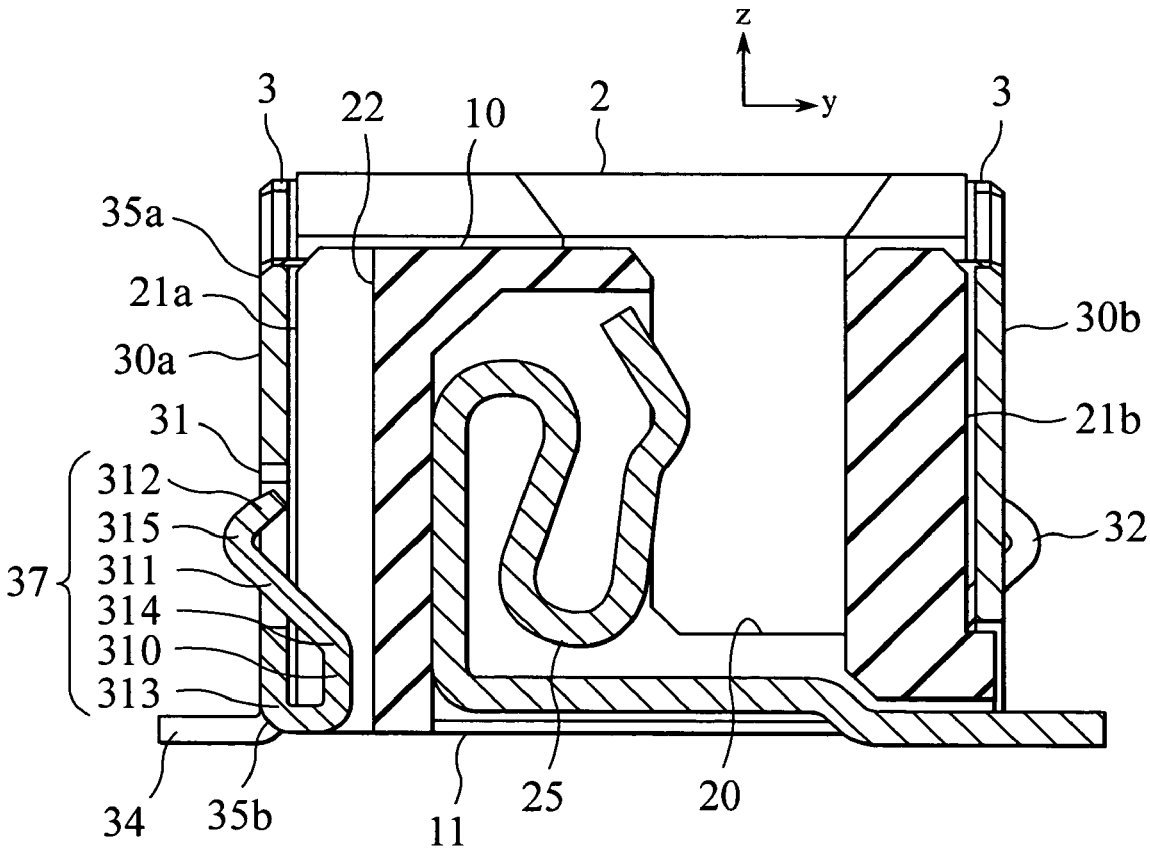
FIG. 8 is a cross sectional view of a connector according to a second embodiment of the present invention.

Referring to FIG. 8, the connector 1 may have a plurality of elastic portions 37 of a second embodiment of the present invention.

The elastic portion 37 has a first piece 310, a second piece 311, a third piece 312, a first bend section 313, a second bend section 314 and a contact section 315.

The first bend section 313 is disposed on the rear edge 35*b* and has a U-shape which is forwardly opened. The first bend section 313 and the hole 31 are arranged along the z-direction. The second bend section 314 is arranged in the first region 36*a*. The first piece 310 extends forwardly from the first bend section 313 to the second bend section 314. The contact section 315 is arranged in the second region 36*b*. The second piece 311 extends forwardly and outwardly from the second bend section 314 to the contact section 315 through the hole 31. The third piece 312 extends forwardly and inwardly from the contact section 315.

Figure 9:
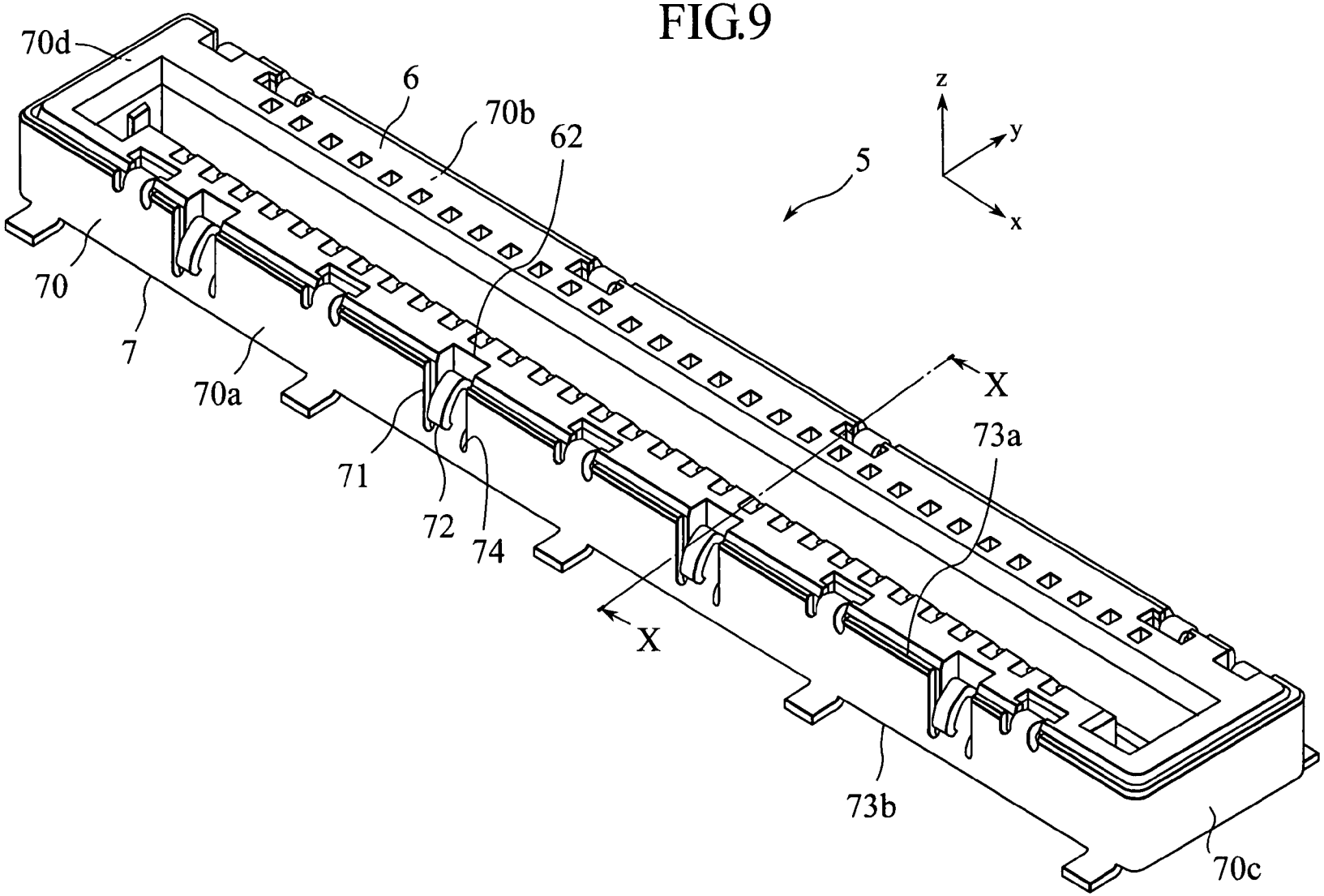
FIG. 9 is a perspective view of a connector according to a third embodiment of the present invention.
Figure 10:
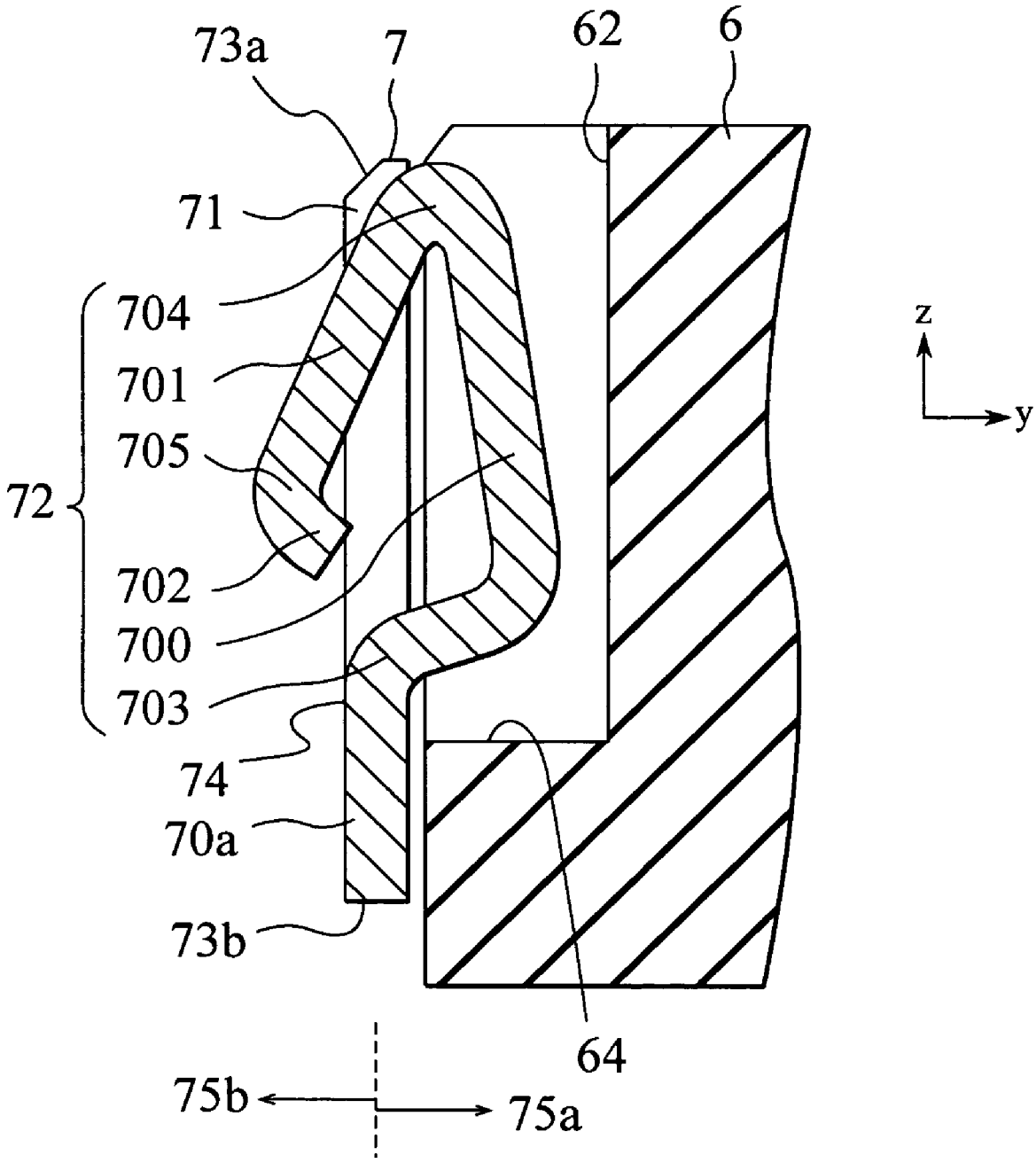
FIG. 10 is a partial cross sectional view of the connector, taken along a line X-X of FIG. 9.

FIG. 9 and FIG. 10 show a connector 5 of a third embodiment of the present invention. The connector 5 comprises a housing 6, a conductive shell 7 and a plurality of terminals (not shown).

Referring to FIG. 9, the housing 6 is provided with a plurality of first recessed portions 62 opened forwardly in the z-direction and opened outwardly in the y-direction.

The conductive shell 7 comprises and a plate portion 70 and a plurality of elastic portions 72. The plate portion 70 has a front edge 73*a* and a rear edge 73*b* arranged at opposed ends of the connector 7 in the z-direction. The plate portion 70 has a first wall 70*a* and a second wall 70*b* arranged at opposed ends of the connector 7 in the y-direction. The plate portion 70 has a third wall 70*c* and a fourth wall 70*d* arranged at opposed ends of the connector 7 in the x-direction. The first wall 70*a* and a second wall 70*b* extend along the x-direction and the z-direction and are provided with a plurality of slit-like openings 71. The first wall 70*a* and the second wall 70*b* define a first region 75*a* between the first wall 70*a* and the second wall 70*b* and also define a second region 75*b* out of the first region 75*a*. The housing 6 is arranged in the first region 75*a*.

The plurality of slit-like openings 71 are arranged along the x-direction. Each of the slit-like opening 71 has an end portion 74 arranged between the front edge 73*a* and the rear edge 73*b*. The slit-like opening 71 is arranged to pierce the first wall 70*a* or the second wall 70*b* in the y-direction and is elongated from the front edge 73*a* to the end portion 74.

Referring to FIG. 10, the elastic portion 72 has a first piece 700, a second piece 701, a third piece 702, a first bend section 703, a second bend section 704 and a contact section 705.

The first bend section 703 is arranged on the end portion 74 and is elongated inwardly. The second bend section 704 is arranged in the first region 75*a*. The first piece 700 extends forwardly from the first bend section 703 to the second bend section 704. The contact section 705 is arranged in the second region 75*b*. The second piece 701 extends rearwardly and outwardly from the second bend section 704 to the contact section 705 through the slit-like opening 71. The third piece 702 extends rearwardly and inwardly from the contact section 705.

Figure 11:
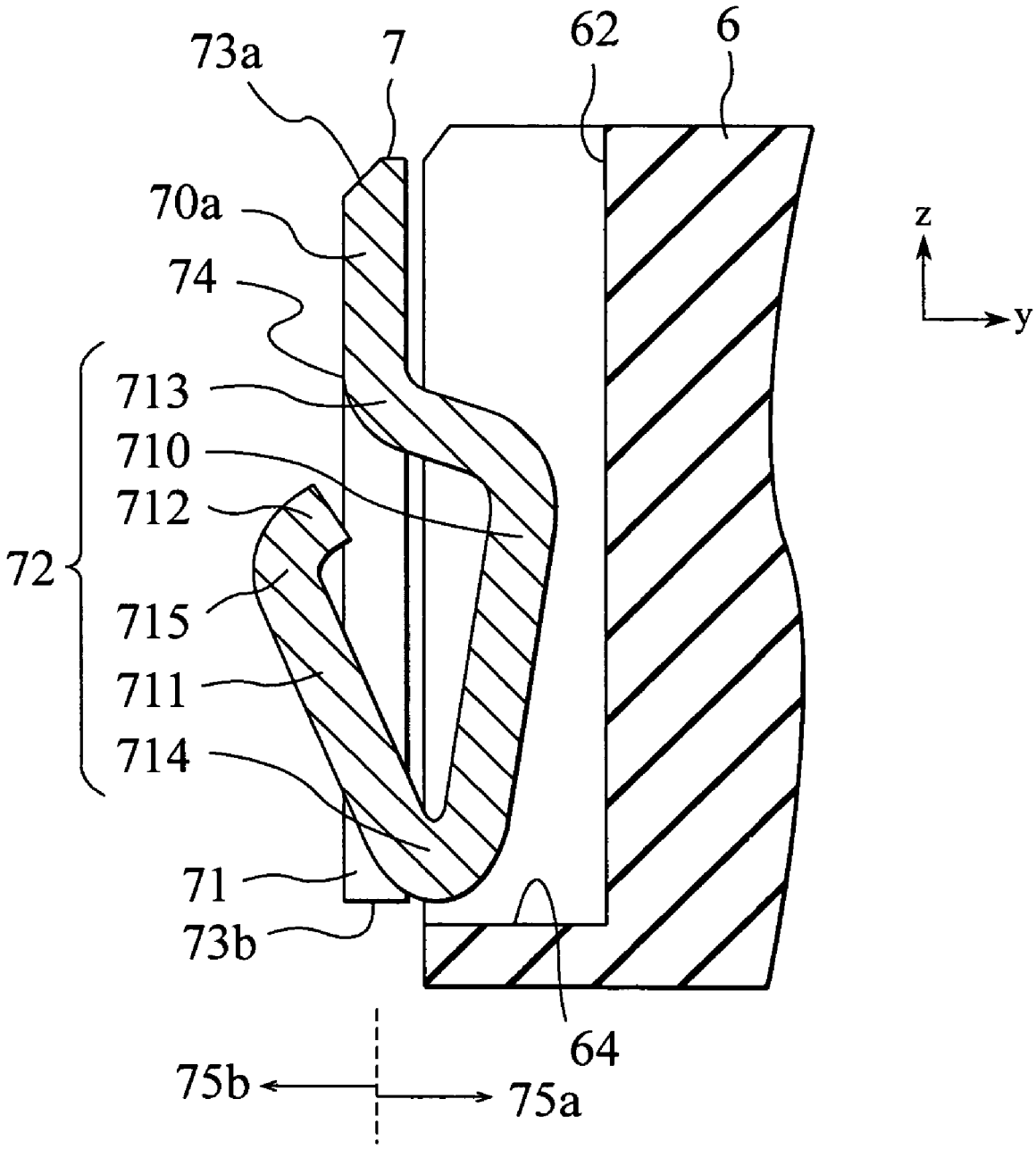
FIG. 11 is a partial cross sectional view of a connector according to a fourth embodiment of the present invention.

Referring to FIG. 11, the connector 7 may have a plurality of elastic portions 72 of a fourth embodiment of the present invention.

The elastic portion 72 has a first piece 710, a second piece 711, a third piece 712, a first bend section 713, a second bend section 714 and a contact section 715.

The first bend section 713 is arranged on the end portion 74 and is elongated inwardly. The second bend section 714 is arranged in the first region 75*a*. The first piece 710 extends rearwardly from the first bend section 713 to the second bend section 714. The contact section 715 is arranged in the second region 75*b*. The second piece 711 extends forwardly and outwardly from the second bend section 714 to the contact section 715 through the slit-like opening 71. The third piece 712 extends forwardly and inwardly from the contact section 715.

This application is based on Japanese Patent Application serial no. 2006-008202 filed in Japan Patent Office on Jan. 17, 2006, the contents of which are herein incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be constructed as being included therein.

What is claimed is:

1. A connector configured to mate with a corresponding connector, the connector comprising:

a conductive shell comprising an elastic portion and a plate portion having an opening;

the plate portion configured to define a first region and a second region and arranged between the first region and the second region;

the elastic portion comprising a first bend section arranged on the plate portion, a second bend section arranged in the first region, a contact section arranged in the second region, a first piece extending between the first bend section and the second bend section and a second piece extending between the second bend section and the contact section through the opening;

a housing arranged in the first region; and a plurality of terminals retained by the housing.

2. The connector according to claim 1, wherein:

the opening is a hole piercing the plate portion;

the plate portion comprises a rear edge and a front edge;

the front edge is positioned in the corresponding connector deeper than the rear edge in a state where the connector is mated with the corresponding connector; and the first bend section is arranged at the front edge of the plate portion.

3. The connector according to claim 1, wherein:

the opening is a hole piercing the plate portion;

the plate portion comprises a front edge and a rear edge;

the front edge is positioned in the corresponding connector deeper than the rear edge in a state where the connector is mated with the corresponding connector; and the first bend section is arranged at the rear edge of the plate portion.

4. The connector according to claim 1, wherein:

the plate portion comprises a rear edge and a front edge;

the front edge is positioned in the corresponding connector deeper than the rear edge in a state where the connector is mated with the corresponding connector; and the first bend section is arranged between the front edge and the rear edge; and the opening has a notch-like shape elongated from the front edge to the first bend section.

5. The connector according to claim 1, wherein:

the plate portion comprises a rear edge and a front edge;

the front edge is positioned in the corresponding connector deeper than the rear edge in a state where the connector is mated with the corresponding connector; and the first bend section is arranged between the front edge and the rear edge; and the opening has a notch-like shape elongated from the rear edge to the first bend section.

6. The connector according to claim 1, wherein:

the connector is mated to the corresponding connector in a predetermined direction;

the elastic portion has a first length from the first bend section to the contact section;

the opening has a second length along the predetermined direction; and the first length is larger than the second length.

7. The connector according to claim 1, wherein the housing comprises a recessed portion facing the opening.

8. The connector according to claim 7, wherein the recessed portion has a bottom inner surface elongated between the rear portion and the recessed portion.

9. The connector according to claim 8, wherein:

the connector is mated to the corresponding connector in a predetermined direction;

the elastic portion comprises a wide portion which has a first width along a width direction orthogonal to the predetermined direction;

the opening has a second width along the width direction; and the first width is larger than the second width.

* * * * *